US005442157A

United States Patent [19]

Jackson

[11] Patent Number: 5,442,157

[45] Date of Patent: Aug. 15, 1995

[54] ELECTRONIC TEMPERATURE CONTROLLER FOR WATER HEATERS

[75] Inventor: Barry N. Jackson, Woodbury, Minn.

[73] Assignee: Water Heater Innovations, Inc., Eagan, Minn.

[21] Appl. No.: 972,964

[22] Filed: Nov. 6, 1992

[51] Int. Cl.[6] ..... H05B 1/02

[52] U.S. Cl. ..... 219/492; 219/497; 219/508; 219/505; 219/483; 374/105; 340/589

[58] Field of Search ..... 219/483, 501, 497, 491, 219/508, 509, 505, 492, 493, 506; 340/588, 589; 374/105, 107

[56] References Cited

U.S. PATENT DOCUMENTS

| | | | |
|---|---|---|---|
| 4,493,981 | 1/1985 | Payne | 219/506 |
| 4,524,264 | 6/1985 | Takeuchi et al. | 219/492 |
| 4,570,054 | 2/1986 | Chidzey et al. | 219/492 |
| 4,585,925 | 4/1986 | Andre | 219/497 |
| 4,587,406 | 5/1986 | Andre | 219/497 |
| 4,740,671 | 4/1988 | Kuroda et al. | 219/492 |
| 5,079,407 | 1/1992 | Baker | 219/448 |
| 5,103,078 | 4/1992 | Boykin et al. | 219/494 |

*Primary Examiner*—Mark H. Paschall
*Attorney, Agent, or Firm*—Moore & Hansen

[57] ABSTRACT

A control/safety apparatus and method for an electrical or fuel fired water heater includes one or more temperature sensors strategically located on the water heater vessel at a level at or above a critical water level. The time rate of temperature change is calculated from the sensed temperature. An abnormal value of temperature change rate corresponding to an insufficient water level deactivates the heater to prevent damage to the heater. Water level, projected heating times, heater malfunctions and other operating parameters may be calculated or detected based on the time rate of change in sensed temperature.

4 Claims, 6 Drawing Sheets

ELECTRONIC TEMPERATURE CONTROLLER FOR WATER HEATERS

BACKGROUND OF THE INVENTION

This invention relates generally to control of liquid heaters such as water heaters. More particularly, this invention pertains to devices and methods for sensing and measuring operating values of flow-through water heaters, as well as using such values to actuate certain control aspects of the water heaters.

Safe operation of water heaters and the like requires that overheating be avoided. In water heaters in which energy is introduced through electrical elements, the water level in the vessel may perchance be below the level of an element. Without contact with the liquid "heat sink", the element may heat to e.g. 1000 degrees F. in less than a minute. The element may melt and fall into the vessel bottom, damaging the coating on a tank or the tank itself. When the vessel wall is constructed of a non-metallic material, heat generated by the overheated element may permanently damage the vessel wall. It may be necessary to shut off the power supply to the element in a fraction of a minute, for example, in order to avoid damage to the element or the vessel.

In the prior art, a thermostat controls the heating elements based on the measured water temperature. In the "dry-fire" condition, the water temperature being sensed at the thermostat may not rise beyond the parameters seen under a normal heating condition, before damage will occur. Thus, reliance cannot be placed on the normal thermostatic control to detect and react to a "dry-fire" state.

The use of thermal fuses in the element port requires that a new fuse be installed upon each thermal overload incident. More importantly, the critical element temperature may sometimes be reached before the fuse overload temperature is reached; the fuse may not respond in time to prevent damage to the elements or water heater vessel.

For gas-fired water heaters, other problems exist. In a modem water heater having a non-metallic vessel, the water is pumped from the vessel through an exterior heating circuit. The circuit includes a heat exchanger, typically a coil, where heat is transferred from the flame and hot combustion gases to the circulating water. A temperature sensor is normally positioned in the heating circuit to measure the water temperature and control the firing cycle.

If the water level in the vessel should drop to below the inlet pipe to the exterior heating circuit, the coil will become empty and the flame and hot combustion gases will overheat the empty coil. The danger of damaging the heat exchanger coil exists.

Other operating disfunctions may also occur. For example, a thermal sensor may be accidently left disconnected from the vessel or the controller. In such cases, the controller will not sense a temperature change, even though the water is being heated. The burner or electrical element will continue to provide thermal energy to the unit even though the maximum planned temperature is exceeded. An unsafe overheat condition may result which damages heater components.

Furthermore, while all water heaters have a safety valve actuated by excess pressure/temperature, this valve will not respond to a dry-fire condition, where there may be no water to expand and overpressurize the vessel, and where any existing water is being heated at a sub-normal rate.

In prior art water heaters, there has been no satisfactory system for minimizing power or fuel usage while simultaneously ensuring adequate hot water supply at the desired temperature and in addition, ensuring safe operation.

The industry needs apparatus and procedures for sensing and calculating actual operating conditions, for detecting unsafe operations resulting from low water levels or disconnected sensors, for taking action to alleviate the unsafe operations, and for determining energy usage and projected heating times.

BRIEF SUMMARY OF THE INVENTION

The invention is a method and apparatus of temperature control for a liquid heating apparatus such as a domestic or commercial water heater, where the heat is supplied by an electrical element or by the combustion of a fuel such as a fuel gas or oil. Specific operations of the heater are initiated if and when the measured rate of temperature change attains predetermined settings.

Whereas prior water heaters and the like have used a simple upper temperature limiting value for shutting off the thermal energy source in the event of a malfunction, this invention uses a different function of the temperature measurement. The time rate of change of the measured temperature is continuously, semi-continuously or sequentially calculated by the control unit, and appropriate corrective actions initiated if the rate e.g. degrees per minute, is not within the normal operating limits. The particular action taken depends upon the measured value of the rate. Specific abnormal events in the heater operation produce identifiable rates which are peculiar to the particular malfunction.

Thus, a normal temperature control scheme using temperature control limits about a preset desired value may be combined with the safety system of the present invention for detecting abnormal operation and shutting off the input energy, whether electrical power or fuel. Of course, a pressure/temperature relief valve is also used as a backup safety measure and to meet industry standards.

In the invention of the present method and apparatus, the rate of temperature change, positive or negative, is electronically determined or calculated over small time increments. The range of "normal" rates of temperature change may be calculated from the known heater configuration, or may be determined from actual use. With the heat source operating at maximum output in a full liquid vessel, the time rate of increase in temperature is the maximum to be expected under normal operating conditions. A severe low water condition, i.e. "dry-fire", results in a sensed rate of temperature increase which is typically 5–25 times greater than the maximum "normal" rate.

Likewise, a malfunction in the burner or heating element, disconnection of the temperature sensor, or problems associated with the flue, etc. may result in a temperature change rate well below the normal rate. In either an above-normal or below-normal rate, the controller may use the calculated rate to sense and determine the aberration and apply a programmed action which prevents hazardous operation and energy wastage. In the event of burnout of an element of an electrical water heater, the controller may be programmed to switch to another element until maintenance service can be provided. The controller may also provide warnings and instructions for correction of malfunctions.

Other details and advantages of the invention will be readily understood by a reading of the following description in conjunction with the accompanying figures of the drawings wherein like reference numerals have been applied to designate like elements throughout the several views.

BRIEF DESCRIPTION OF THE DRAWINGS

In the Figures.

DESCRIPTION OF THE PREFERRED EMBODIMENTS

Figure 1:
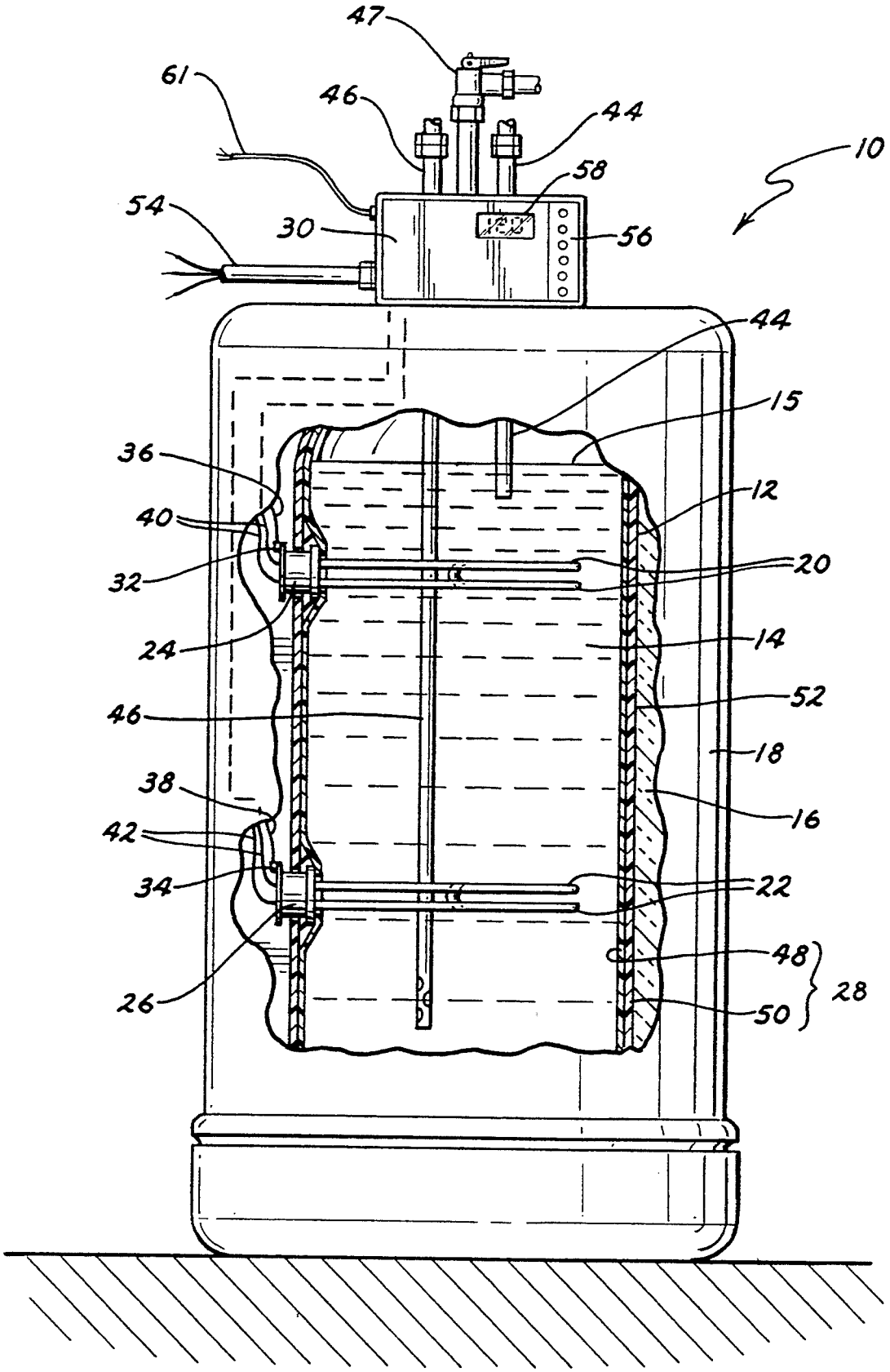
FIG. 1 is a partially cut-away side elevation of an electric water heater having the control system of the invention.

With reference to the drawings, and particularly to FIG. 1, an electric water heater 10 is shown with the general control elements of the invention. The water heater 10 comprises a vessel generally designated by the numeral 12 for holding and heating water 14. The water 14 is shown as having a variable upper level 15. The water heater 10 is shown as including insulation 16 overcovering a major portion of the vessel 12, and an external shell or jacket 18. The heater 10 also includes heating means which comprises upper and lower electric heating elements 20 and 22 mounted in ports 24, 26 passing through the vessel wall 28. A controller unit 30 receives readings from temperature sensors 32 and 34 through conduits generally designated as 36 and 38, respectively and controls the introduction of electrical power from supply conduit 54 through conductor sets 40, 42 to the heating elements 20 and 22. The heater 10 also includes water inlet pipe 44, outlet pipe 46, and pressure/temperature relief valve 47.

While the invention is useful with metallic or non-metallic vessels, it is illustrated in a particularly advantageous application with a non-metallic vessel 12. The vessel wall 28 is illustrated as being a laminate formed of an inner layer or liner 48 and an outer layer 50. The cylindrical portion 52 of the outer layer 50 is typically oriented vertically and may be formed of fibers or other materials in a thermoset resin substrate for providing the necessary strength, rigidity and structural integrity at the elevated operating conditions. The inner layer 48 is made of a material which is resistant to deterioration and leakage at the operating environment within the vessel 12. However, such materials typically deform or melt at a lower temperature than steel or glass-lined steel, and therefore must be protected from excess temperatures resulting from "dry-firing" i.e. operating with an electric heating element unsubmerged in the water.

The elements 20 and 22 may be individually controlled in sequence to achieve the desired supply of hot water with enhanced energy conservation. When the required water supply is relatively low, the heater 10 may be reduced in size and have only a single heating element. More than two elements may be used if desired, operated in sequence.

Small single element heaters have the element mounted in the lower portion of the tank for heating the entire vessel contents in a relatively short period of time. Larger vessels having a greater length:diameter ratio may require two or more elements to enable some heated water to be available in a reasonable period of time rather than wait for the entire vessel contents to be heated to the desired temperature. Multi-element heaters are operated so that the elements actuate sequentially to reduce the maximum power draw and minimize overall power consumption.

The control unit 30 is shown with a control panel 56 for changing control settings, accessing control memory, etc. Measured and computed values of control factors, status information, instructions and various warnings may be accessed or viewed on a display 58 for ease of control.

In the present invention, the controller includes a microcomputer. A control program is written into the ROM (read only memory) or EPROM (erasable programmable read only memory) to include setpoints; variable data such as sensed "water" temperatures at one or more locations and status of the heating elements may be stored in the RAM (random access memory). The controller functions and set points may be controlled from the control unit or panel 30 at the water heater 10. If desired, the apparatus may be configured so that the collected data and functions calculated therefrom may be electronically transferred via remote cable 61 for access, viewing and control at a remote station, not shown in FIG. 1. Thus, for example, setpoints may be preset and various other specific operations controlled from a remote console.

The controller may be programmed to include various modes of operation such as calibration. Thus, in a "calibration" mode, the controller acts as the means for standardizing and calibrating the water heater functions to counteract any variations in the equipment. For example, slight differences in sensor calibration may be accounted for in the computer program to achieve uniformly accurate heater operation.

The temperature sensors useful in this invention may be of any fast-acting type with an electronic or electrical output. Thermisters, RTDs or other resistance output sensors are typically used because of their simplicity, reliability and cost.

The sensors 32, 34 are typically mounted on heat conductive ports 24, 26 at or above a critical level in the vessel 12. This critical level may be the level of a heating element of an electric water heater. Activation of an element with a water level below the critical level results in a condition of "dry fire".

In a fuel fired water heater having a separate heating circuit external of the vessel, the critical level may be the level of the entrance to the heating circuit within the vessel. Loss of liquid level to below that point will result in a dry recirculation pipe, also denoted herein as "dry fire".

During normal heater operation, the port is in contact with liquid water 14 and rapidly conducts heat to the sensor. The sensor's output reflects the water temperature.

Dry fire in an electrical water heater occurs when the heating element is activated when not immersed in water. In this state, the sensor port, being at the same level, is also substantially or completely not in contact with the water, and receives heat by direct conduction and radiation from the hot heating element. Without the liquid heat sink to absorb the thermal energy, the increased heat transfer to the port results in a rapidly rising port temperature which is sensed by the sensor. This temperature rise rate is substantially higher than that during normal operation, and is the means by which a "dry fire" condition is detected.

In a fuel fired water heater with a separate heating circuit, the sensor may be mounted on the port by which heated water enters the vessel, or on its own port. The water heater should always be full of water and pressurized to the house system pressure. During normal heating operation, the sensor senses a normal temperature rise rate of the water absorbing heat from the burner. Should the water level be so low as to produce a "dry fire" condition, the sensed temperature will not rise at a rate in the normal range but will rise more slowly, if at all. This low rate of temperature rise is detected by the controller.

When the controller calculates a temperature rate of change which equals a preset value representing "dry fire", the controller shuts off the heating energy to prevent damage to the water heater components. For an electric water heater, "dry fire" is detected when the rate of temperature change meets or exceeds the preset value. For a fuel fired water heater with a separate heating circuit, "dry fire" is detected when the rate of temperature change is equal to or less than a preset value representative of a "dry fire" condition.

Figure 7:
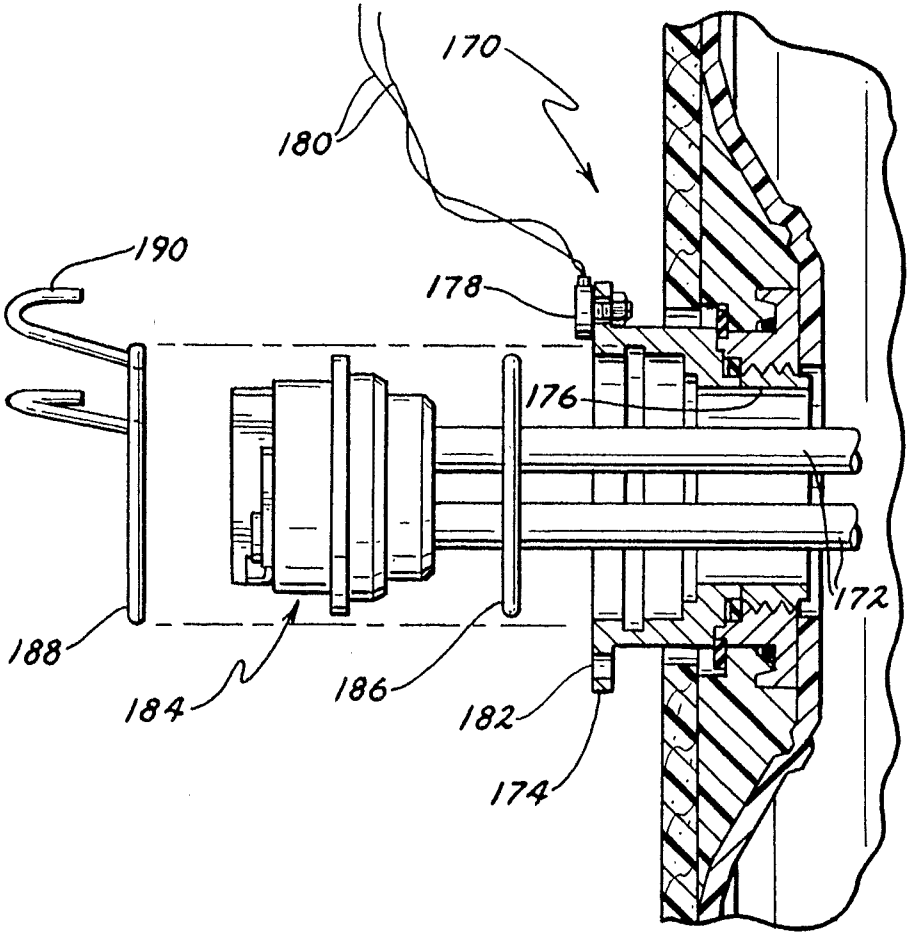
FIG. 7 is a lateral sectional view of an embodiment of sensor and port in accordance with the invention.
Figure 6:
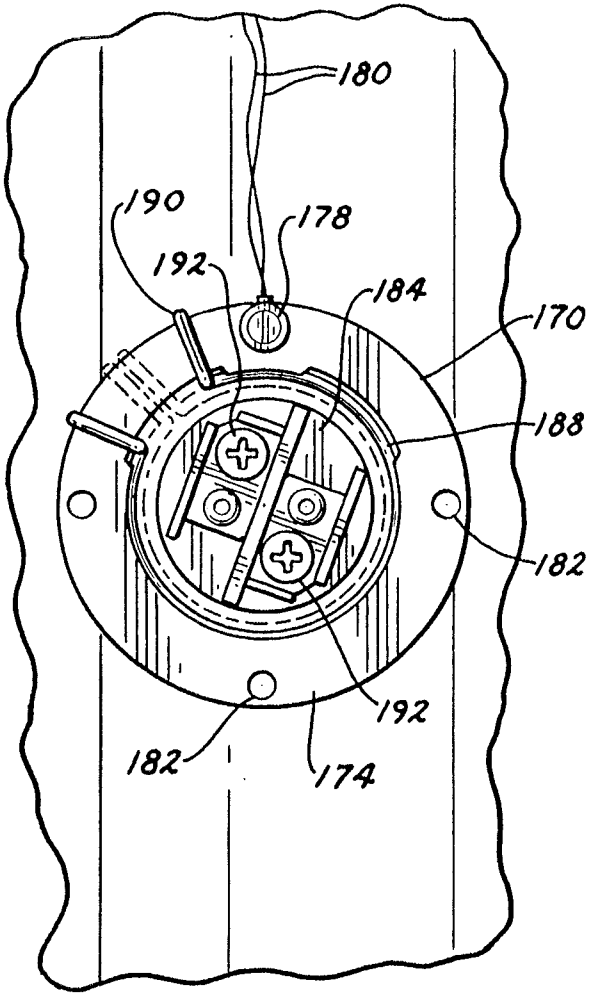
FIG. 6 is a front view of an embodiment of the sensor mounted on a exemplary port in accordance with the invention.

Port constructions useful in the invention are described infra and shown in FIGS. 6 and 7.

Figure 2:
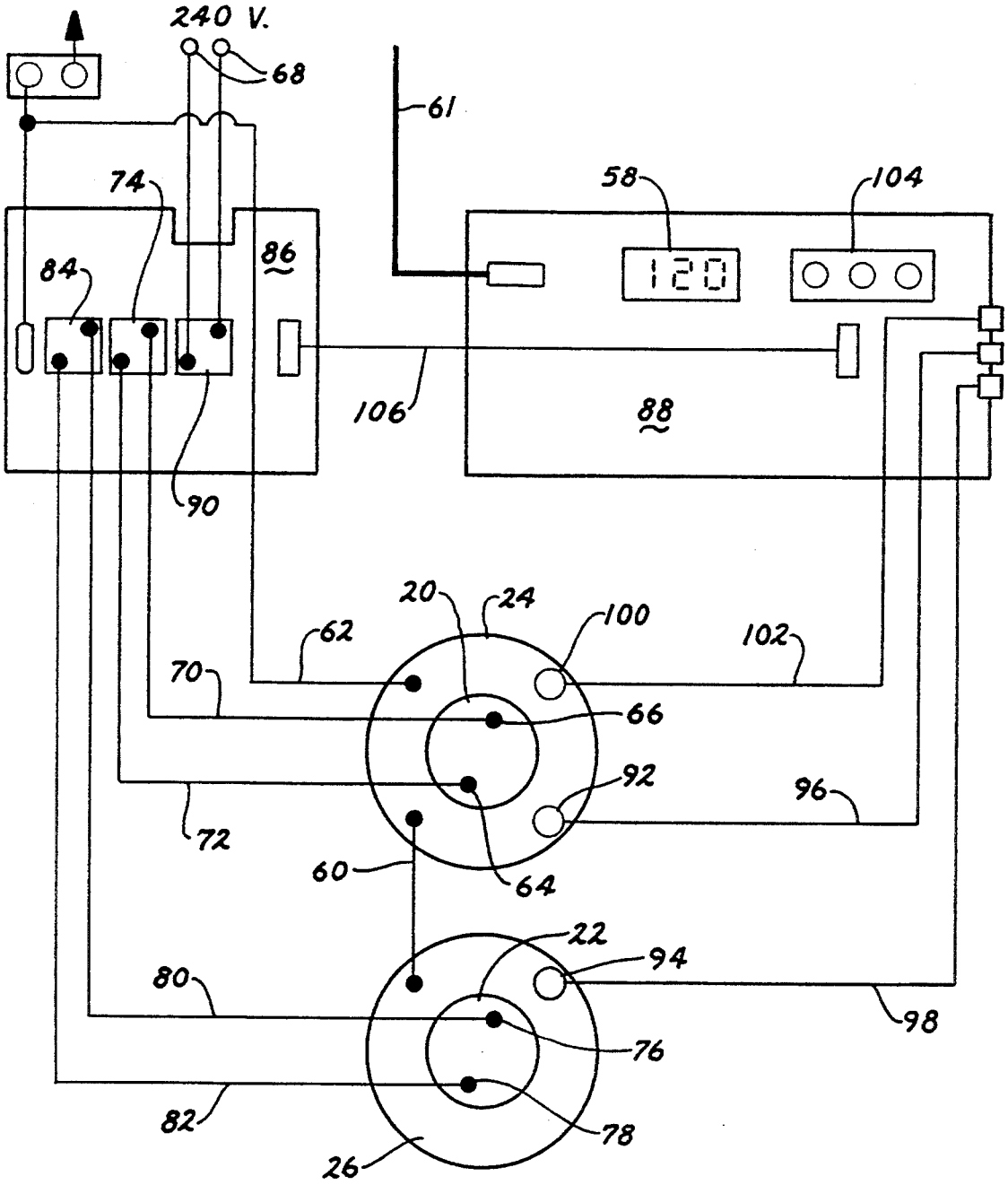
FIG. 2 is a generalized wiring schematic of an embodiment of the control apparatus of the invention for an electric water heater.

FIG. 2 shows a simplified electrical diagram for an exemplary two-element electric heater of the invention. The controller unit is pictured as including a power board 86 and a display board 88. An upper heating element 20 is mounted in upper port 24, and a lower heating element 22 is mounted in lower port 26. Element 20 has terminals 64, 66 which are shown connected to a 240 volt power supply 68 by wires 70, 72 through switch 74. Likewise, element 22 has terminals 76, 78 which are connected to the power supply 68 by wires 80, 82 through switch 84. The power supply 68 is introduced through circuit breaker 90. The two ports are grounded by ground wires 60 and 62.

Attached to the upper and lower ports 24, 26 are temperature sensors 92, 94 for sensing the water temperatures at those levels and for activating/deactivating the heating elements 20, 22 to maintain preset temperatures. These sensors also provide temperature signals for calculating the timed rate of change in temperature, and for calculating values of other operating parameters, if desired. Each sensor is connected to the controller unit by 2-wire leads 96, 98, respectively. A safety sensor 100 is attached to the upper port 24 and is connected via a 2-wire lead 102 to the controller unit. This sensor 100 is a backup upper limit temperature sensor for shutting the heater down if a high temperature is detected.

The display board is shown with a display 58 for viewing values of control and operating functions. If desired, alarms, instructions and other information may be displayed here in accordance with the programmed controller. A panel 104 is shown with keys for accessing the memory of the controller and for presetting and viewing control variables. The various electronic conduits connecting the display board 88 and power board 86 are represented by line 106.

If desired, display and control functions may be routed to a distant monitor/controller via remote cable 61.

Figure 3:
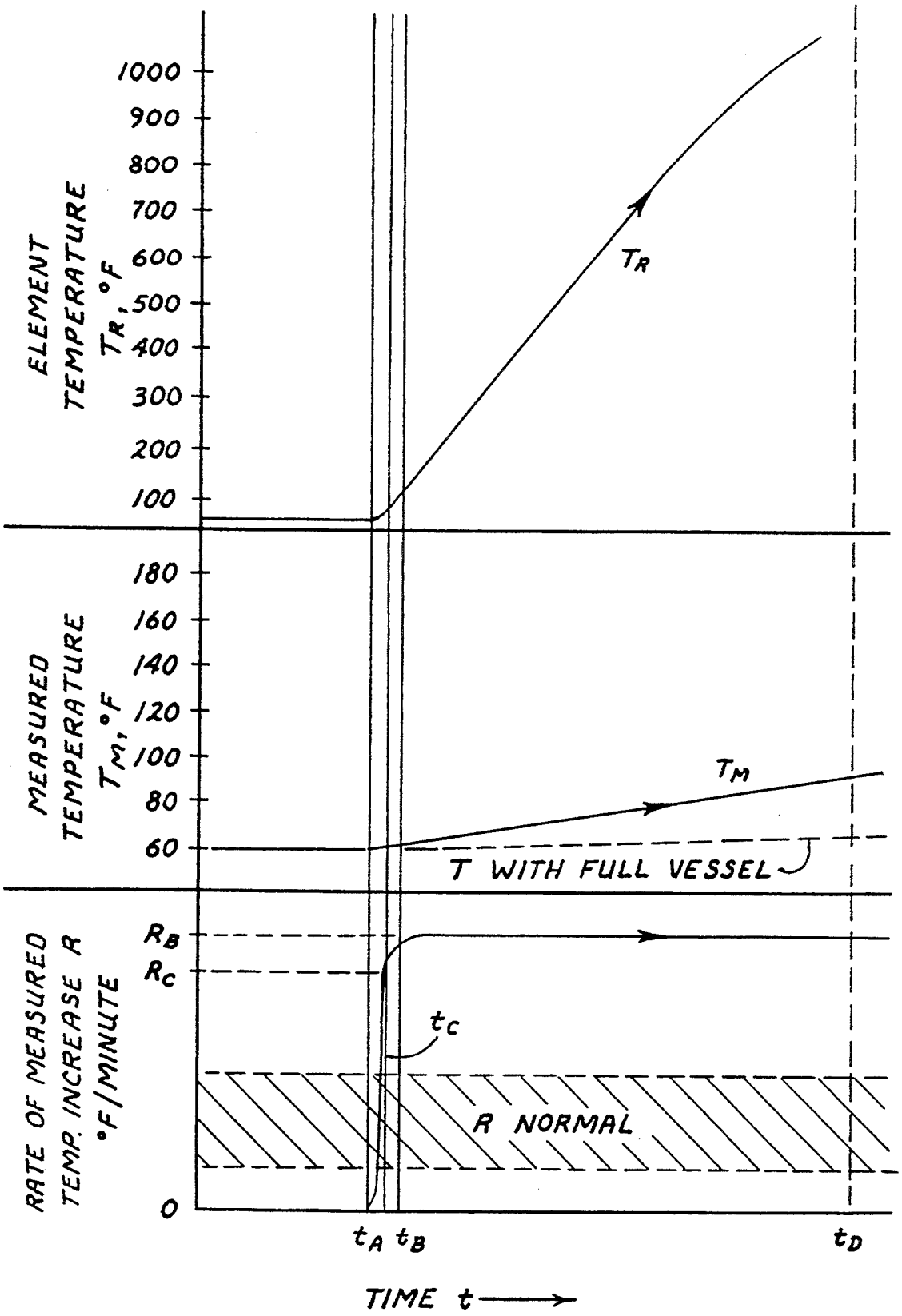
FIG. 3 is a graphical representation of the relationship between water level and sensed temperature in the vessel of an electric: water heater of the invention.

FIG. 3 illustrates the principles of the control process, as applied to a water heater with electrical heating elements. The actual element temperature $T_R$ and sensed "water" temperature $T_M$, together with the rate of change R in sensed temperature, are plotted as a function of time. The figure illustrates what occurs when a heater is started without first filling the vessel with water. Such may occur upon an initial start-up or following maintenance, for example. A dry-fire condition may have catastrophic effects upon the heater if not checked in a short time.

In this graph, $t_A$ represents the time at which the elements are electrically activated for heating the water.

From the figure, one can see that the element temperature quickly attains about 1000 degrees F. at time $T_D$, typically in less than one minute. The measured "water" temperature $T_M$ is shown as rising much more slowly, i.e. at a rate $R_B$. Rate $R_B$ is however much higher than the rate $R_{NORMAL}$ of temperature change during normal operation with water present.

In this invention, the controller may be preset to shut off the power to the element if the rate of temperature change reaches $R_C$, a value less than the maximum measured rate $R_B$. The time for this to occur is very short, i.e. $T_C - T_A$. Thus the element is deactivated long before it approaches a deleterious temperature. The possibility of damage to the heating elements and vessel is avoided.

It should be noted that the deactivation of this method occurs before the sensed "water" temperature reaches a high temperature cutoff at e.g. 180 degrees F. Use of such a cutoff based on temperature rather than a rate of temperature change is not as effective in preventing damage to the element, vessel or other heater components.

Figure 4:
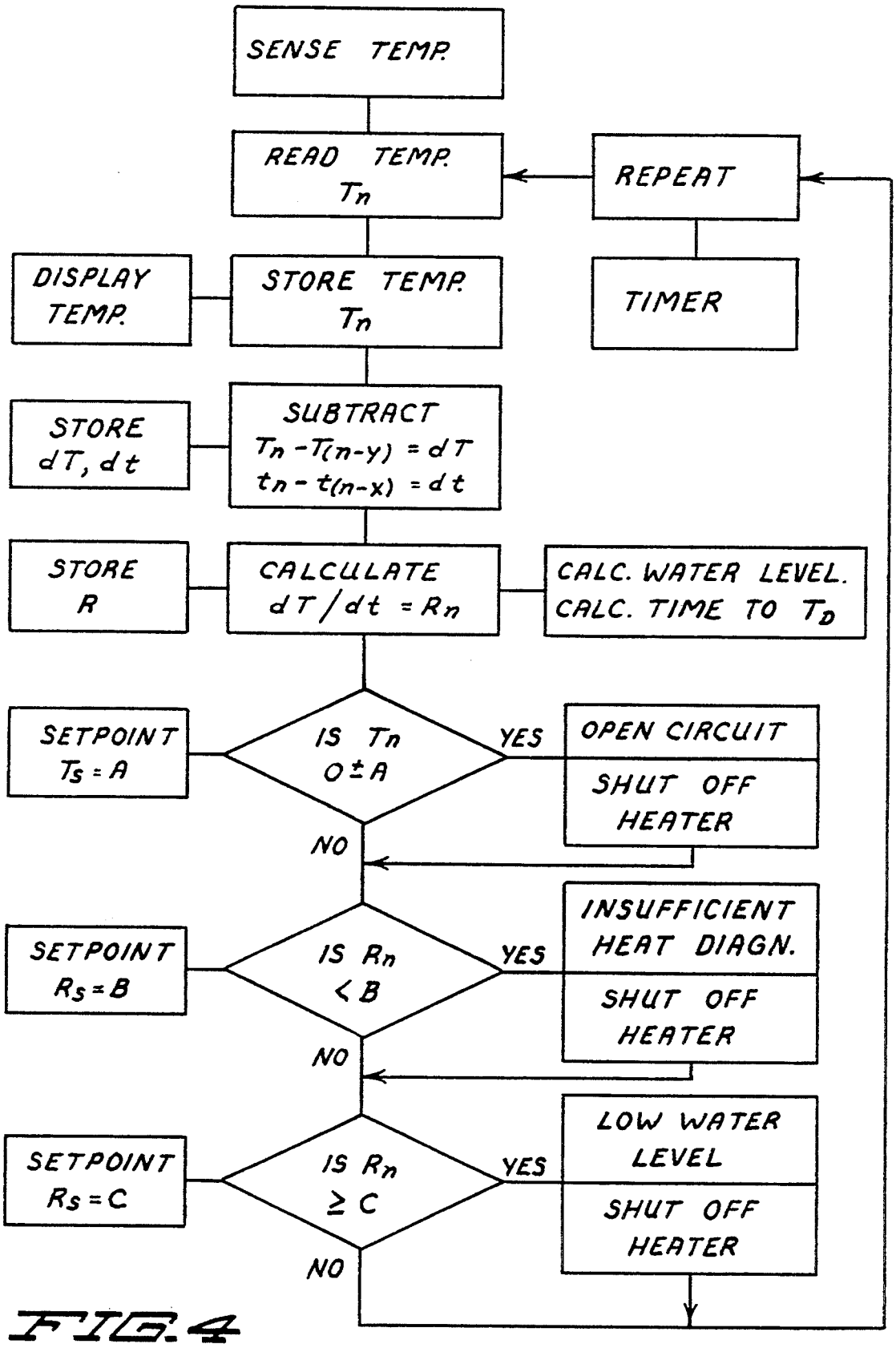
FIG. 4 is a flow chart showing exemplary logic steps of the controller of the invention as typified in FIG. 2.

FIG. 4 shows an exemplary set of mathematical steps which result in values for various operating parameters useful in assessing and controlling the heater operation. The steps are shown for an electrical heater, and are to be slightly modified when used with a fuel fired heater.

The sensed temperature T is read at time $t_n$ to give temperature value $T_n$. The value is stored. A previously sensed temperature $T_{n-y}$ sensed at time $t_{n-x}$ is subtracted from $T_n$ to yield a temperature change dT over time period dt. These values may be stored for future reference.

The ratio of dT to dt is calculated to produce a rate of change in temperature $R_n$ when the heating element is activated. For an exemplary electrical water heater, $R_n$ may be on the order of 1–2 degrees F. per minute during normal heating operations. Various operating parameters of the water heater may be determined from abnormal calculated values of $R_n$:

(a) as long as the water level is above the sensor, the volume of water in the vessel may be determined as an inverse function of $R_n$;

(b) a value of $R_n$ which is zero or near-zero indicates that the sensor is not operating, possibly because it is not properly installed. Alternatively, the heater is not operating, despite being electrically activated;

(c) a value of $R_n$ which is below the normal operating range may result from a high water usage rate or a malfunctioning element;

(d) a value of $R_n$ which is higher than the normal range indicates a low water level resulting in a "dry fire" condition; typically the "dry fire" value of $R_n$ is 2–10 times the normal operating value of $R_n$; and (e) the time required to heat the water from the present temperature to the preset operating temperature may be calculated by dividing the temperature difference by the heating rate $R_n$. If the rate $R_n$ varies with actual water temperature, correction factors may be included in the computation program to provide the desired accuracy.

Specific actions may be programmed into the controller to shut off the heating element(s) when an abnormal operation is indicated. In addition, messages indicating the problem and recommended action may be recalled from memory to be displayed on the monitor.

It should be recognized that the mathematical functions may take alternate forms, yet provide the same information. The foregoing discussion is exemplary in nature and provides the computational steps in their simplest form.

Figure 5:
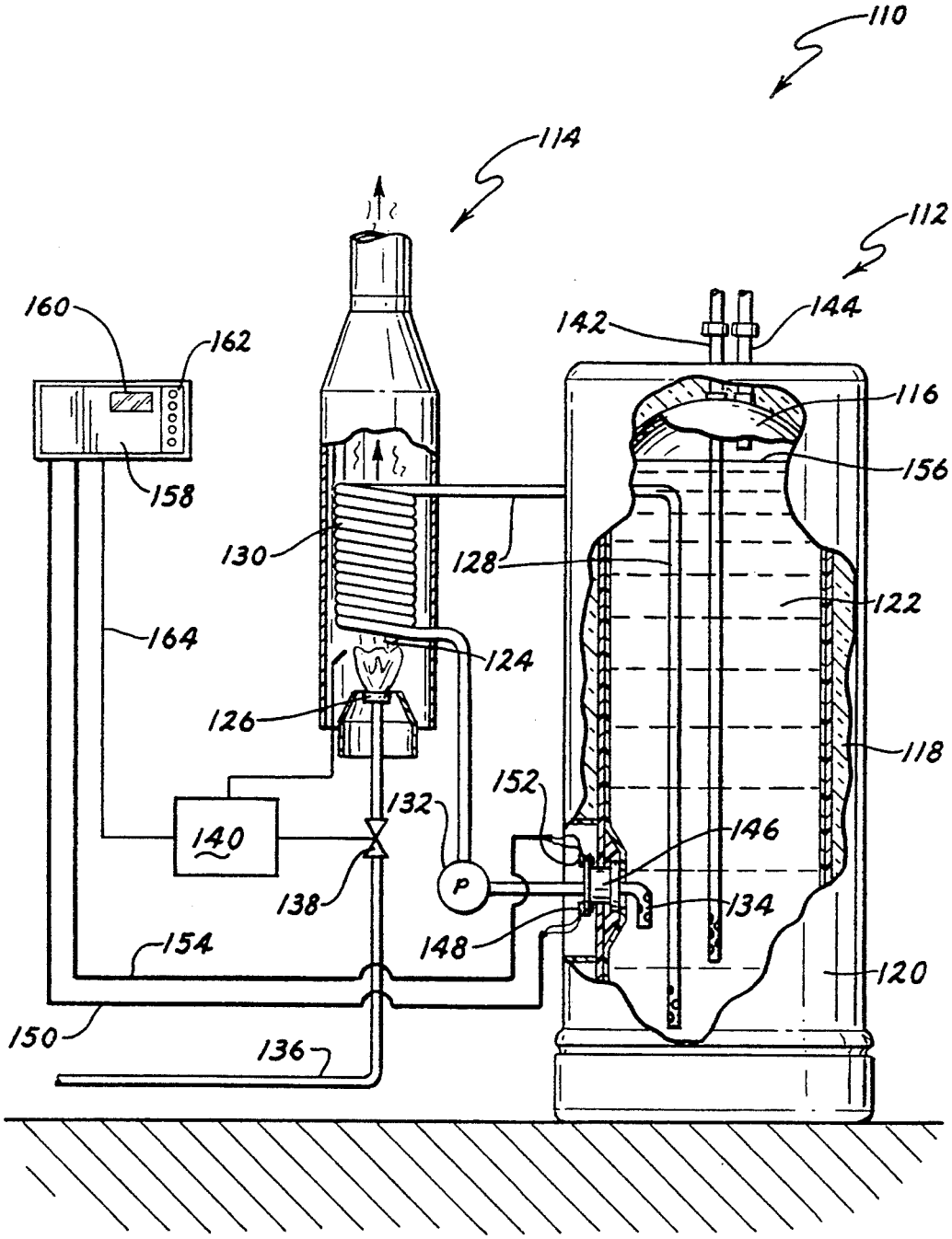
FIG. 5 is a partially cut-away side elevation of a gas-fired water heater to which the invention is applied.

The major components of a gas-fired water heater 110 having the control method of the invention are shown schematically in FIG. 5. The heater is shown with a vessel assembly 112 and a separate heating module 114. A non-metallic interior vessel 116 contains the heated water 122, and is covered with insulation 118 and an exterior jacket 120.

Water 122 is heated by combustion gases 124 from burner 126. Water 122 to be heated is drawn from the vessel 116 through vessel outlet pipe 128 into heat exchanger coils 130 which lie in the stream of hot combustion gases 124. Heated water passes from the coils 130 to pump 132, which pumps the water through vessel inlet pipe 134 into the vessel 116. Fuel gas is passed through gas supply line 136 to burner 126, and is controlled with a valve 138 by controller subunit 140. The fuel may be ignited by any apparatus used in the industry.

Heated water is drawn from the vessel 116 through hot water line 142. Supply water is introduced to the water heater vessel 116 through an inlet 144 to replace water withdrawn.

The vessel inlet pipe 134 is shown mounted in a heat conductive port 146. A temperature sensor 148 is mounted on an exterior portion of the port 146 to measure the temperature of water 122 adjacent the interior surface of the port. An electrical signal is transmitted from sensor 148 through 2-wire leads 150 to the controller unit 158, which then controls the activation of the gas valve 138 and burner 126 through controller subunit 140 to maintain the desired preset water temperature. The sub-unit 140 may include a standard ignition control unit which is well known in the art. A second sensor 152 is shown attached to the port 146. This sensor may be used for timed temperature measurements used in calculating various water heater functions based on the time rate of change in temperature. Sensor 152 is shown with 2-wire leads 154 for transmitting the temperature measurements to the controller unit 158.

Alternatively, all of the measured temperature values could be obtained from a single sensor, or each function could be computed using its own temperature sensor.

As with the electric water heater, several possible functions may be computed by the controller, based on a calculated time rate of temperature change. These include:

(a) the volume of water in the water heater, and/or water level 156 in the vessel 116, (b) the elapsed time to heat the water in the vessel, (c) a disconnected or non-operative sensor, and (d) a low water level resulting in a "dry fire" condition.

In contrast to the values indicating such a condition in the electrical water heater, the indicative rate value is zero or a very low value, because the heater is remote from the sensor. In such a "dry fire" condition, a lack of recirculating water results in essentially no heat transfer to the vessel contents comprising air and water vapor.

The controller shown comprises subunit 140 and controller unit 158 having a display 160 and manipulable controls 162 for accessing the memory and control functions. Preferably, all computations and data handling are performed in controller unit 158, from which signals are transmitted to subunit 140 to actuate the fuel valve 138. This permits standard off-the-shelf items to be used in subunit 140.

Alternatively, the various computation and memory functions may be distributed in any way between the subunit 140 and controller unit 158; these two units are connected by electrical/electronic conduits represented by line 164.

Several port configurations useful in this invention are described in a copending application of even assignee under Ser. No. 07/958,018, filed Oct. 7, 1992. The disclosure of this application is incorporated by reference. The ports provide a large surface area for water contact with a path for high thermal conduction rates to a sensor. In addition, they provide for direct conduction of heat from a dry heating element, as well as for heating of the port by radiation from the dry element.

One of these port 170 configurations is shown in FIGS. 6 and 7, with a bayonet mounted electrical heating element 172 ready to be installed therein. The port is shown with an annular outer flange 174 which provides a continuous metal path to the interior of the vessel. The interior portion of the flange 174 has a surface 176 normally in contact with water. This surface 176 also is close to the heating element 172 so that during a "dry fire" event, heat is transferred to the port 170 by radiation as well as by conduction. A temperature sensor 178 is attached to a hole 182 in the flange 174 for sensing the temperature of the port. The sensor 178 is connected to a control unit, not shown,, by 2-wire conduit 180.

The heating element assembly 184 is sealed in port 170 by o-ring 186, and held in place by lock ring 188 with handles 190. Terminals 192 of the heating element 172 are connected to a power source through the controller.

The advantages of this system include:

1. A rapid shutdown in the event of a "dry fire" episode.
2. Various parameters important to the efficient operation of the heater may be continuously or semi-continuously determined.
3. The system may be adapted for either electrical and fuel fired heaters, with minimal configurational changes.
4. The control system uses minimal hardware space.

5. Status of the water heater may be obtained at any time, together with instructions in the event of a malfunction.
6. The apparatus is inexpensive to manufacture, and easy to install.

It is anticipated that various changes and modifications may be made in the construction, arrangement and operation of the heater control system disclosed herein without departing from the spirit and scope of the invention as defined in the following claims.

What is claimed is:

1. A monitoring apparatus for a water heater having a heating means and a closed pressure vessel for containing heated water, comprising:

temperature sensing means for sensing the temperature of the water in the vessel as a function of time;

means for calculating a rate of change in the sensed temperature;

control means for controlling said heating means based on the calculated rate of change in the sensed temperature;

means for determining a "dry-fire" condition corresponding to an abnormal time rate of sensed temperature change;

means for shutting off the water heater when a calculated time rate of change in the sensed temperature attains a preset value corresponding to a "dry-fire" condition; and a separate heating circuit external said vessel for recirculating water from said vessel, wherein said heating means comprises a fuel fired heat exchanger means in said separate circuit, and wherein said means for determining a "dry-fire" condition comprises presettable control means for determining an abnormal time rate of change in sensed temperature of said water in said vessel lower than the normal rate of temperature change.

2. A water heater, comprising:

a pressure vessel for holding water undergoing heating:

thermal energy input means having means for activation and deactivation thereof;

temperature sensing means for determining the temperature of the water;

first control means for controlling the operating water temperature within preset upper and lower temperature values, said first control means connected to said sensing means;

second control means connected to said first control means, comprising:

timing means for determining said measured temperature at successive timed intervals and calculating a first rate value representing the time rate of temperature change;

means for presetting a second value representing an abnormal time rate of temperature change;

comparing means for comparing said calculated first rate value with said preset second value;

relay means for deactivating said thermal energy input means to stop energy input when said first rate value attains said preset second value; and reset means for activation of said thermal energy input means, wherein said preset second value comprises a rate higher than the normal heating rate and is a rate representing a reduced water level in said vessel.

3. A water heater, comprising:

a pressure vessel for holding water undergoing heating:

thermal energy input means comprising an electrical heating means having means for activation and deactivation thereof for heating while submerged in said water;

temperature sensing means for determining the temperature of the water;

first control means for controlling the operating water temperature within preset upper and lower temperature values, said first control means connected to said sensing means;

second control means connected to said first control means, comprising:

timing means for determining said measured temperature at successive timed intervals and calculating a first rate value representing the time rate of temperature change;

means for presenting a second value representing an abnormal time rate of temperature change;

comparing means for comparing said calculated first rate value with said preset second value;

relay means for deactivating said thermal energy input means to stop energy input when said first rate value attains said preset second value; and a bayonet heating element port having said sensing means mounted on the exterior thereof, said heating element port having a continuous heat conductive metal path between said water and said sensing means for measuring the water temperature when water contacts said port, and for receiving radiation energy from heating portions of said heating element and conductive energy from the base of said element when the water level is reduced to expose said element, said radiation and conductive energy providing an elevated time rate of change increasing temperature signal from said sensing means.

4. A water heater, comprising;

a pressure vessel for holding water undergoing heating:

a separate heating circuit external said vessel wherein water is recirculated from said vessel;

thermal energy input means comprising a fuel burner and having means for activation and deactivation comprising valve means for activating/deactivating the flow of fuel thereto, said burner for heating a portion of said heating circuit;

temperature sensing means for determining the temperature of the water;

first control means for controlling the operating water temperature within preset upper and lower temperature values, said first control means connected to said sensing means;

second control means to said first control means, comprising:

timing means for determining said measured temperature at successive timed intervals and calculating a first rate value representing the time rate of temperature change;

means for presetting a second value representing an abnormal time rate of temperature change;

comparing means for comparing said calculated first rate value with said preset second value;

relay means for deactivating said thermal energy input means to stop energy input when said first rate value attains said preset second value;

a sensor mount having a heat conductive metal path between said water in said vessel and said sensing means, said sensing means disposed to sense changes in water temperature when in contact therewith and to sense if the level of water in the vessel is below the sensor mount, wherein a drop in water level below said sensor mount causes said calculated value of time rate of change in sensed temperature to attain said preset second value lower than a value representative of normal heating.

* * * * *